US009868316B2

(12) United States Patent
Park

(10) Patent No.: US 9,868,316 B2
(45) Date of Patent: Jan. 16, 2018

(54) BOOK PROVIDED WITH STORAGE GROOVE FOR WRITING IMPLEMENTS

(71) Applicant: KOREAONE Co., Ltd., Seoul (KR)

(72) Inventor: Beom Jin Park, Seoul (KR)

(73) Assignee: KOREAONE CO., LTD., Seoul (KR)

( * ) Notice: Subject to any disclaimer, the term of this patent is extended or adjusted under 35 U.S.C. 154(b) by 66 days.

(21) Appl. No.: 14/900,304

(22) PCT Filed: Jun. 24, 2014

(86) PCT No.: PCT/KR2014/005601

§ 371 (c)(1),
(2) Date: Dec. 21, 2015

(87) PCT Pub. No.: WO2014/208995

PCT Pub. Date: Dec. 31, 2014

(65) Prior Publication Data

US 2016/0368303 A1 Dec. 22, 2016

(30) Foreign Application Priority Data

Jun. 27, 2013 (KR) ..... 10-2013-0074130
Jun. 27, 2013 (KR) ..... 10-2013-0074132
Jun. 23, 2014 (KR) ..... 10-2014-0076504

(51) Int. Cl.
*B42D 1/00* (2006.01)
*B42D 3/10* (2006.01)

(52) U.S. Cl.
CPC ..... *B42D 1/007* (2013.01); *B42D 3/10* (2013.01); *B42P 2241/04* (2013.01); *B42P 2241/18* (2013.01)

(58) Field of Classification Search
CPC ..... B42D 1/007
(Continued)

(56) References Cited

U.S. PATENT DOCUMENTS 741,878 A * 10/1903 Bogart ..... B42D 1/004 281/30
1,308,437 A * 7/1919 Metcalf ..... B42D 3/12 281/30

(Continued)

FOREIGN PATENT DOCUMENTS

EP 2343197 7/2011
JP 2002104492 4/2002

(Continued)

OTHER PUBLICATIONS

International Search Report—PCT/KR2014/005601 dated Aug. 25, 2014.

*Primary Examiner* — Kyle Grabowski
(74) *Attorney, Agent, or Firm* — Cantor Colburn LLP

(57) ABSTRACT

A book with the storage groove for writing implements comprises: an inner sheet part formed by being cut into a certain size; a cover part comprising a front cover part disposed to cover the front surface of the inner sheet part and a back cover part disposed to cover the rear surface of the inner sheet part; a writing implement storing groove formed at the fore-edge of the inner sheet part such that a writing implement is seen from the outside and formed in a longitudinal direction of the writing implement; and a binding band formed of an elastic string and disposed to surround and bind at least one of the outside of the front cover part and the outside of the back cover part in a horizontal direction.

7 Claims, 9 Drawing Sheets

(58) Field of Classification Search
USPC ..... 281/30
See application file for complete search history.

(56) References Cited

U.S. PATENT DOCUMENTS

| | | | | | |
|---|---|---|---|---|---|
| 2,332,425 | A * | 10/1943 | Aranoff | B42D 3/12 | 281/30 |
| 2,486,840 | A * | 11/1949 | Harris | B42D 5/006 | 281/30 |
| 7,360,960 | B2 * | 4/2008 | Hite | B42D 5/003 | 281/30 |
| 2005/0095057 | A1 * | 5/2005 | O'Hara | B42D 1/007 | 402/57 |
| 2009/0278344 | A1 * | 11/2009 | Hadden-Wight | B42D 3/12 | 281/30 |

FOREIGN PATENT DOCUMENTS

| | | |
|---|---|---|
| JP | 2004142402 | 5/2004 |
| JP | 2007529342 | 10/2007 |
| JP | 3158651 | 3/2010 |
| JP | 3158651 U * | 4/2010 |
| KR | 2020080001711 | 6/2008 |
| KR | 2020090002088 | 3/2009 |
| KR | 20100025563 | 3/2010 |
| KR | 20100061327 | 6/2010 |
| KR | 2020120005280 | 7/2012 |
| KR | 20140013477 | 2/2014 |

* cited by examiner

BOOK PROVIDED WITH STORAGE GROOVE FOR WRITING IMPLEMENTS

TECHNICAL FIELD

The present invention relates to a book capable of storing writing implements, and more particularly, to a bookbinding having a lateral portion, an uppermost end portion, or a lowermost end portion provided with a groove capable of storing writing implements.

BACKGROUND ART

Generally, bookbindings such as notebooks for study or diaries are provided with a holder or a clip for holding writing implements, or are provided with a spot where the clip of a writing implement such as a ballpoint pen can be fitted. However, this holder or clip causes the increase of the volume of bookbindings. Also, since the fixing method that uses the holder or clip, or the clip of writing implement itself is implemented such that the writing implement is exposed, there is an inconvenience in that the writing implement may be caught on dress or bag during transportation or storage or may be separated from the holder to be lost.

Korean Utility Model Application Publication No. 20-2008-0001711 filed by Baek-Min, Kim discloses a book having a storage groove for writing implements. Here, the storage groove for writing implements having a certain depth is formed by punching an oblong through hole in every sheet of a portion of papers of a book bound with papers cut in a certain size at a certain location of the bookbinding such that writing implements can be inserted and portably stored therein.

Since the writing implement is safely stored in a book and thus is not exposed to the outside, the risk of loss and interruption during transportation can be reduced. However, since the oblong through hole is punched in the inner sheets and thus the storage groove is formed in the middle part of the body of the book, the efficiency of the inner sheets and there is a limitation in printing and writing on the body of the book. Also, the inner sheets may be easily torn. Also, the above-mentioned utility model is not provided with a separate member for fixing the cover part of the book. Accordingly, when the cover part of the book is opened during transportation due to carelessness of a user, the writing implement may be separated from the storage groove, and thus there is a risk of loss and damage.

DISCLOSURE

Technical Problem

Accordingly, The present invention provides a book with a storage groove for writing implements, which can carry a writing implement, and can facilitate storage and transportation without a separate protrusion part formed on the outside of the book.

Technical Solution

In one general aspect, a book with the storage groove for writing implements includes: an inner sheet part formed by being cut into a certain size; a cover part including a front cover part disposed to cover the front surface of the inner sheet part and a back cover part disposed to cover the rear surface of the inner sheet part; a writing implement storing groove formed at the fore-edge of the inner sheet part such that a writing implement is seen from the outside and formed in a longitudinal direction of the writing implement; and a binding band formed of an elastic string and disposed to surround and bind at least one of the outside of the front cover part and the outside of the back cover part in a horizontal direction.

Also, the writing implement storing groove may be formed to have a width such that the front cover part or the inner sheet part can pressurize the writing implement from the front side of the book and the back cover part or the inner sheet part can pressurize the writing implement from the rear side of the book to prevent the writing implement from being separated from the writing implement storing groove when the book is closed. When the cover part is divided into three equal parts along the vertical length from the uppermost side to the lowermost side of the cover part, the binding band may be disposed at the intermediate region of the three equal parts.

The writing implement storing groove may include a holder that is disposed on the inner sheet of the cover part forming one side the writing implement storing groove to press and fix the writing implement by making contact with the body of the writing implement.

Also, a cuttable surface may be formed in the inner sheet part so as to adjust the thickness of the writing implement storing groove according to a user's selection.

In another general aspect, a book with the storage groove for writing implements includes: an inner sheet part formed by being cut into a certain size; a cover part including a front cover part disposed to cover the front surface of the inner sheet part and a back cover part disposed to cover the rear surface of the inner sheet part; a writing implement storing groove formed at the fore-edge of the inner sheet part such that a writing implement is seen from the outside and formed in a longitudinal direction of the writing implement; and a binding band formed of an elastic string and disposed to surround and bind at least one of the outside of the front cover part and the outside of the back cover part in a diagonal direction.

Also, the writing implement storing groove may be formed to have a width such that the front cover part or the inner sheet part can pressurize the writing implement from the front side of the book and the back cover part or the inner sheet part can pressurize the writing implement from the rear side of the book to prevent the writing implement from being separated from the writing implement storing groove when the book is closed. The binding band may be disposed to surround the upper end or the lower end of the cover part and the fore-edge of the cover part.

Also, the writing implement storing groove may be formed to have a width such that the front cover part or the inner sheet part can pressurize the writing implement from the front side of the book and the back cover part or the inner sheet part can pressurize the writing implement from the rear side of the book to prevent the writing implement from being separated from the writing implement storing groove when the book is closed. The binding band may include a first binding band disposed to surround the upper end of the cover part and the fore-edge of the cover part and a second binding band disposed to surround the lower end of the cover part and the fore-edge of the cover part.

The writing implement storing groove may include a holder that is disposed on the inner sheet of the cover part forming one side the writing implement storing groove to press and fix the writing implement by making contact with the body of the writing implement.

Also, a cuttable surface may be formed in the inner sheet part so as to adjust the thickness of the writing implement storing groove according to a user's selection.

In another general aspect, a book with the storage groove for writing implements includes: an inner sheet part formed by being cut into a certain size; a cover part including a front cover part disposed to cover the front surface of the inner sheet part and a back cover part disposed to cover the rear surface of the inner sheet part; a cuttable surface formed in the inner sheet part so as to directly form a writing implement storing groove by removing a portion of the inner sheet part; and a binding band formed of an elastic string and disposed to surround and bind at least one of the outside of the front cover part and the outside of the back cover part.

The book with the storage groove for writing implements according to another embodiment of the present invention may include an inner sheet part formed by being cut into a certain size, a cover part including a front cover part disposed to cover the front surface of the inner sheet part and a back cover part disposed to cover the rear surface of the inner sheet part, a writing implement storing groove formed such that a writing implement can be seen from the outside and formed in a longitudinal direction of the writing implement, and a binding band formed of an elastic string and disposed to surround and bind at least one of the outside of the front cover part and the outside of the back cover part.

The writing implement storing groove may be formed to have a width such that the front cover part or the inner sheet part can pressurize the writing implement from the front side of the book and the back cover part or the inner sheet part can pressurize the writing implement from the rear side of the book to prevent the writing implement from being separated from the writing implement storing groove when the book is closed, and the writing implement storing groove may be formed at the uppermost side of the inner sheet part.

The writing implement storing groove may be formed to have a width such that the front cover part or the inner sheet part can pressurize the writing implement from the front side of the book and the back cover part or the inner sheet part can pressurize the writing implement from the rear side of the book to prevent the writing implement from being separated from the writing implement storing groove when the book is closed, and the writing implement storing groove may be formed at the lowermost side of the inner sheet part.

Other features and aspects will be apparent from the following detailed description, the drawings, and the claims.

Advantageous Effects

The present invention provides a book provided with a storage groove for writing implements, which has a groove formed on the lateral surface of the book and storing a writing implement and includes a binding band capable of binding and fixing a cover part of the book. The storage groove for writing implements may be formed to have a width narrower than the diameter of a typical writing implement. Accordingly, when a writing implement is stored in the storage groove, the writing implement can be inserted and fixed in the inner sheets of the book. Also, a groove may be provided on the fore-edge opposite to the spine of the book that is the bound side of the book, and a pen holder may be provided on the inner side of the front cover part that covers the groove. Thus, the writing implement can be safely stored and transported. In addition, the area of the printing surface or the writing surface of the inner sheets can be maximized without a worry of weakening of the binding strength of the inner sheets even though the storage groove is formed.

Since the storage groove for writing implements is formed using the margin surface of the inner sheet part, there is no need to increase the volume of the book in order to have the storage groove for writing implements. Also, since the writing implements are stored by being embedded in the fore-edge of the book, there is no interruption during transportation, and the writing implements can be taken out and used when necessary even without opening the cover part of the book.

Also, a binding band is provided for a notebook type of booklet, and thus memo papers, photographs, and business cards can be stored in addition to writing implements.

Since the cover part is bound with the binding band having elasticity, separation can be prevented during movement or storage.

BEST MODE

Figure 1:
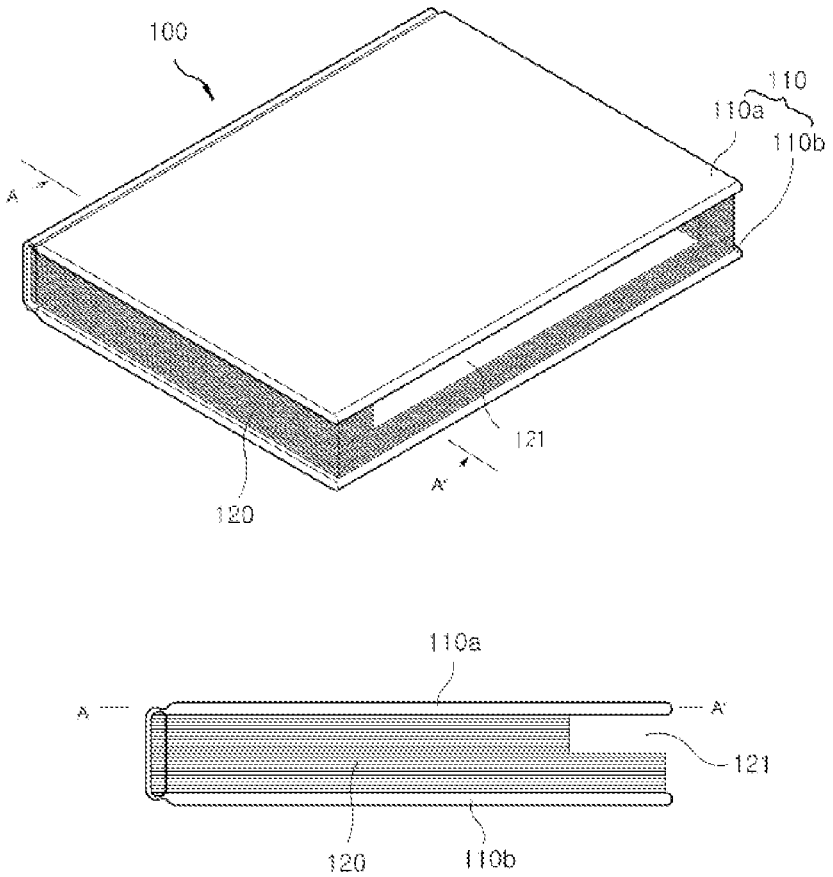
FIG. 1 are a perspective view and a front view illustrating a book with a storage groove for writing implements according to an embodiment of the present invention.

Hereinafter, exemplary embodiments will be described in detail with reference to the accompanying drawings. Throughout the drawings and the detailed description, unless otherwise described, the same drawing reference numerals will be understood to refer to the same elements, features, and structures. The relative size and depiction of these elements may be exaggerated for clarity, illustration, and convenience. The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Figure 2:
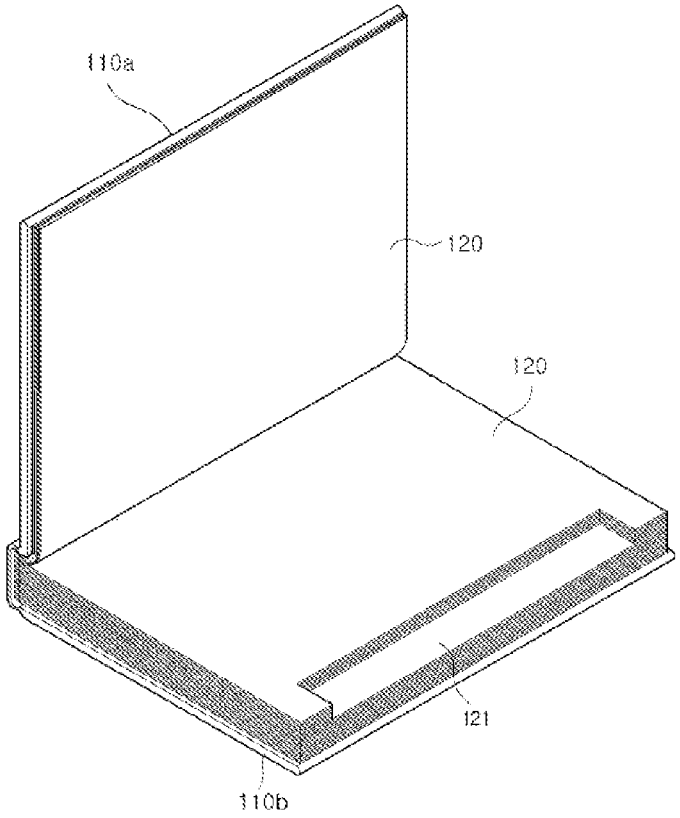
FIG. 2 is a perspective view illustrating an opened book with a storage groove for writing implements according to an embodiment of the present invention.
Figure 3:
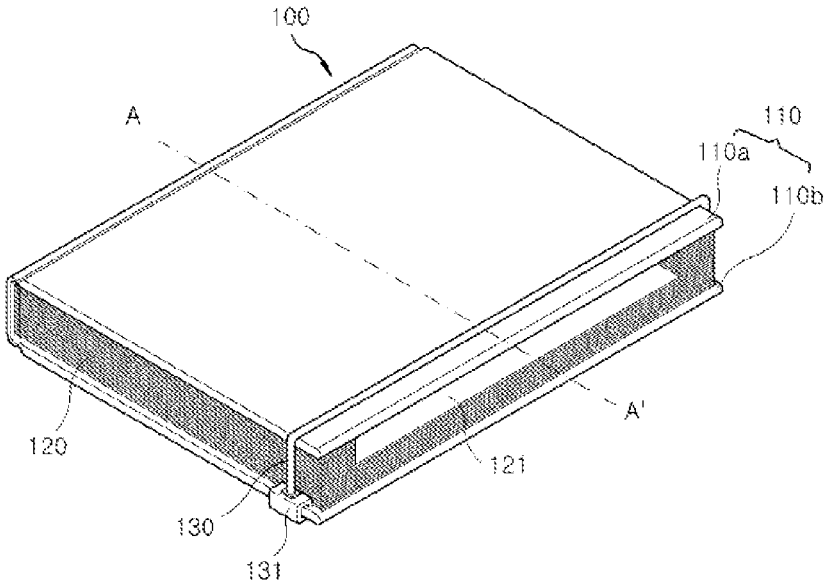
FIG. 3 is a perspective view illustrating a binding band of a book with a storage groove for writing implements according to an embodiment of the present invention.
Figure 4:
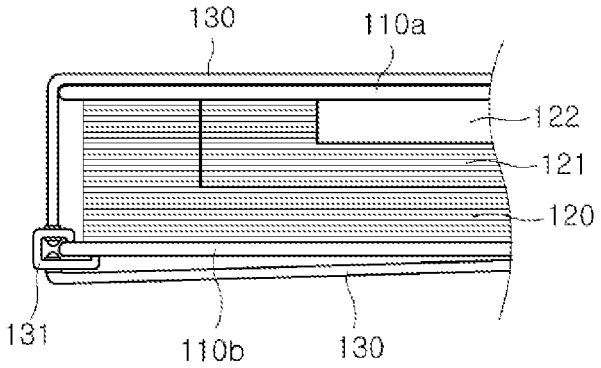
FIG. 4 is a side view illustrating a binding band of a book with a storage groove for writing implements according to an embodiment of the present invention.
Figure 5A:
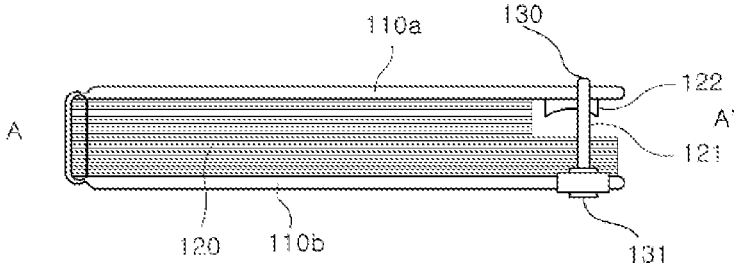
FIG. 5A is a cross-sectional view illustrating a storage groove for writing implements in a book with a storage groove for writing implements according to an embodiment of the present invention.
Figure 5B:
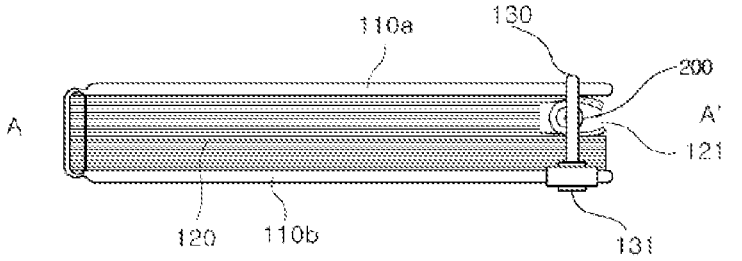
FIG. 5B is a cross-sectional view illustrating a storage groove for writing implements in a book with a storage groove for writing implements according to another embodiment of the present invention.
Figure 5C:
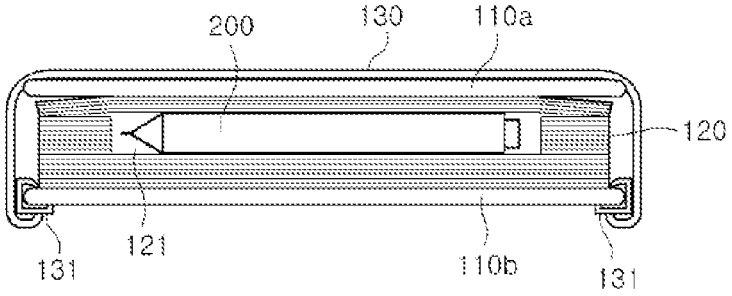
FIG. 5C is a side view illustrating a storage groove for writing implements in a book with a storage groove for writing implements according to another embodiment of the present invention.
Figure 6:
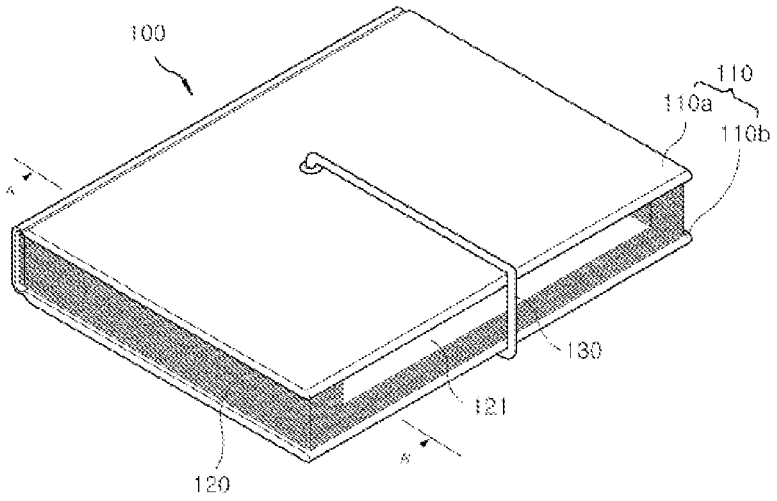
FIG. 6 is a perspective view illustrating a binding band of a book with a storage groove for writing implements according to another embodiment of the present invention.
Figure 7:
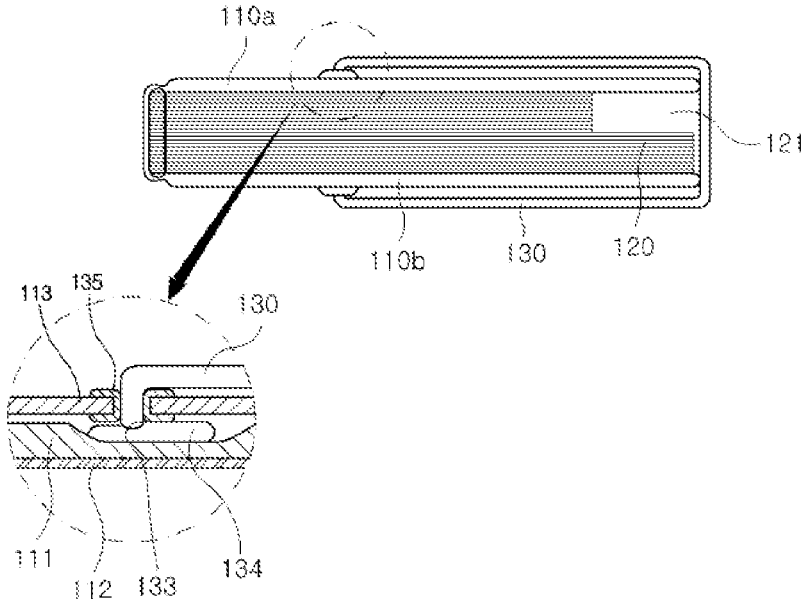
FIG. 7 are a front view and a cross-sectional view illustrating a binding band of a book with a storage groove for writing implements according to another embodiment of the present invention.

FIG. 1 are a perspective view and a front view illustrating a book with a storage groove for writing implements according to an embodiment of the present invention. FIG. 2 is a perspective view illustrating an opened book with a storage groove for writing implements according to an embodiment of the present invention. FIG. 3 is a perspective view illustrating a binding band of a book with a storage groove for writing implements according to an embodiment of the present invention. FIG. 4 is a side view illustrating a binding band of a book with a storage groove for writing implements according to an embodiment of the present invention. FIG. 5A is a cross-sectional view illustrating a storage groove for writing implements in a book with a storage groove for writing implements according to an embodiment of the present invention. FIG. 5B is a cross-sectional view illustrating a storage groove for writing implements in a book with a storage groove for writing implements according to another embodiment of the present invention. FIG. 5C is a side view illustrating a storage groove for writing implements in a book with a storage groove for writing implements according to another embodiment of the present invention. FIG. 6 is a perspective view illustrating a binding band of a book with a storage groove for writing implements according to another embodiment of the present invention. FIG. 7 are a front view and a cross-sectional view illustrating a binding band of a book with a storage groove for writing implements according to another embodiment of the present invention.

Referring to FIGS. 1 and 3, a book with a storage groove for writing implements may include a cover part 110, an inner sheet part 120, a writing implement storing groove 121, and a binding band 130.

The inner sheet part 120 may include papers constituting the inner sheet of the book, and may be formed by being cut into various sizes according to the specification of a typical bookbinding. Books may be formed such that the contents of book can be printed on the inner sheets, and notebooks such as pocket notebooks or diaries may be formed to have ruled lines or grid lines. The inner sheet part may be formed such that a plurality of sheets are overlapped so as to have a plurality of pages, and may be bound at one side thereof so as to be opened in a fan shape.

The binding of the inner sheet part 120 may be implemented by various methods such as stitch binding, perfect binding, hard cover binding, limp binding, and spiral binding.

The cover part 110 may form the back and cover of a book by being bonded to a knot part where the inner sheet part 120 is bound or being stitched using a thread, and may cover the inner sheet part 120 to protect the inner sheet part 120. The cover part 110 may include a front cover part 110*a* corresponding to the front surface of the book and a back cover part 110*b* corresponding to the rear surface of the book.

In general, the cover of book may be formed by adhering an inner sheet and an outer sheet to an inner paper that is prepared using a hard paperboard thicker than the inner sheet or a laminated paper formed by overlapping a plurality of papers. The cover part 110 may be formed to have the same length and width as the inner sheet part 120, or may be formed to have a size slightly larger than the inner sheet part 120 according to the binding forms of general hard cover bindings in order to protect the fore-edge of the inner sheet part 120.

The writing implement storing groove 121 may be formed by cutting a portion of the fore-edge of the inner sheet part 120. That is, the writing implement storing groove 121 may not be formed by adding a separate material to the fore-edge of the inner sheet part 120, but may be formed by cutting and binding the fore-edge of the inner sheet part 120 into a groove form. The writing implement storing groove 121 may also be formed by cutting the whole of the inner sheet part 120, and may also be formed by cutting only a portion of the inner sheet part 120 in accordance with the thickness of the inner sheet part 120. Since the writing implement storing groove 121 is formed by cutting the inner sheet part 120 into a groove shape without adding a separate material or configuration, writing implements may be separated through the opening of the groove when the writing implements are stored in the groove.

Referring to FIGS. 4 and 5A, in order to prevent a writing implement from being separated from the writing implement storing groove 121, a holder 122 may be provided in an inner sheet part 120 where the cover part 110 makes contact with the writing implement storing groove 121. The holder 122 may have a concave groove so as to receive a typical pen having a cylindrical shape, and may be formed to engage with the writing implement storing groove 121. Accordingly, when a pen or a pencil (not shown) is stored in the writing implement storing groove 121 and the cover part 110 is closed, the holder 122 may push down the pen or the pencil stored in the writing implement storing groove 121 and thus may prevent the pen or the pencil from being separated from the writing implement storing groove 121.

The holder 122 may serve to prevent the writing implement stored in the writing implement storing groove 121 from being separated, but the present invention is not limited to the protruding shape having a concave groove as described above. For example, the holder 122 may vertically extend from one end of the cover part 110, and thus may cover the writing implement storing groove 121 when the cover part 110 is closed. In this case, the holder 122 may be formed of the same material as the cover part 110, or may be formed of a material different from the material of the cover part 110. Also, a clip formed of metal or plastic may be provided on the cover part 110.

Referring to FIGS. 3 and 6, a binding band 130 may be disposed to allow the holder 122 to continuously push down the pen or the pencil. The binding band 130 may be disposed to surround the outer surfaces of the cover part 110 in a vertical or horizontal direction, and may be formed of an elastic string. Thus, the binding band 130 may be pulled and untied to open the cover part 110.

Referring to FIG. 4, both ends of the binding band 130 may be fixed on binding band clips 131, and the binding band clips 131 may be detachably fixed to one side of both upper and lower end portions of one of the front cover part 110*a* and back cover part 110*b* of the cover part 110 so as to bind the cover part 110. The binding band clip 131 may be formed of a steel material, and may be fixed by being simply fastened to the end portion of the cover part 110. Also, a hole may be formed in the binding band clip 131 such that the binding band 130 can pass therethrough and fixed therein.

Referring to FIG. 6, another exemplary binding band 130 is shown. The binding band 130 may be disposed to bind the cover part 110 in a vertical direction. As shown in the drawing, the binding band 130 may also be disposed to fix the cover part 110 in a horizontal direction by being fixed to the front cover part 110*a* and the back cover part 110*b*. In this case, when a user intends to untie the binding band 130, the user may pull the binding band 130 and then pass the binding band 130 over or under a book body 100 such that the binding band 130 is located on the spine of the book. Thus, the cover 100 part can be opened.

Referring to FIG. 7, knot clips 134 may be attached to both ends of the binding band 130. Thus, the binding band 130 may be inserted into and fixed in the cover part 110 by the knot clips 134. In other words, the binding band 130 may be fixed by embedding the knot clip 134 in an outer sheet 113 and a hard paperboard 111 of the cover part 110. In this case, a rivet 135 may be disposed in the band hole 133 of the outer sheet through which the binding band 130 passes to prevent the abrasion of the outer sheet 110. As shown in FIG. 7, the band hole 133 may include the rivet 135 disposed therearound to protect the band hole 133, or may not include the rivet 135 in accordance with the material of the cover part 110 or the shape of the binding band.

When the binding band 130 has a section of a flat belt shape, not a cylindrical shape, the band hole 133 may not include the rivet 135 additionally attached thereto, and may be formed only by punching the outer sheet 110.

Referring to FIGS. 5B and 5C, another exemplary writing implement storing groove 121 is shown. The writing implement storing groove 121 may be formed to have a width smaller than the diameter of a typical writing implement. Thus, the writing implement 200 may not be separated from the writing implement storing groove 121 by pressurizing the cover part 110 by the binding band 130 while the writing implement 200 stored in the writing implement storing groove 121 is being pushed by the cover part 110.

In this case, the writing implement storing groove 121 may be formed to have a length of about 10 cm to about 19 cm and a width of about 0.3 cm to about 0.9 cm. The diameter of the typical writing implement 200 may have a diameter of about 0.8 cm. Accordingly, when the writing implement 200 is stored in the writing implement storing groove 121 and the cover part 110 is closed, the cover part 110 may be spaced away from the inner sheet part 120, and may make contact with the writing implement 200. That is, one side of the writing implement 200 may make contact with the bottom surface of the writing implement storing groove 121, and the other side of the writing implement 200 may make contact with the cover part 110. Thereafter, when the cover part 110 is tied with the binding band 130, the writing implement 200 may be fixed and unseparated. Referring to FIG. 5B, the binding band 130 may be located at the edge of the cover part 110 so as to vertically or inwardly push the writing implement 200 stored in the writing implement storing groove 121 by a force applied by the binding band 130, pushing the edge of the fore-edge of the book and the upper and lower edges of the book at the front cover part 110*a*. Thus, the writing implement 200 may not be separated from the writing implement storing groove 121 and may be safely stored in the writing implement storing groove 121 even during movement or transportation.

In this case, the writing implement storing groove 121 may be formed such that the inner sheet part 120 is not cut from the first page thereof. Thus, the writing implement 200 may be pushed by a portion of the inner sheet part 120 and the front cover part 110*a*. Specifically, since the front cover part 110*a* is formed of a thick material, the writing implement 200 may make contact with a relatively smaller area of the front cover part 110*a* when the writing implement 200 is pushed by the binding band 130. Accordingly, as described above, when a portion of the sheets of the inner sheet part 120 pushes the writing implement 200 together with the front cover part 110*a*, the inner sheet part 120 formed of a relatively thinner material than the front cover part 110*a* may make contact with a larger area than front cover part 110*a*, enabling stronger grip of the writing implement 200.

Hereinafter, the action of a book with a storage groove for writing implements according to an embodiment of the present invention will be described.

A user may open the cover part 110 of the book body 100, and then may store a pen or pencil in the writing implement storing groove 121. When a user again closes the cover part 110, the holder 122 disposed at the side of the inner sheet 112 of the cover part 110 may press the pen or the pencil (not shown). Thereafter, a user may pull the binding band 130 to bind the cover part 110.

According to an embodiment of the binding band 130, a user may install the binding band 130 using the binding band clip 131 disposed at one end of upper and lower sides of the back cover part 110*b*, and may bind the front cover part 110*a* using the binding band 130 to fix the cover part 110. The binding band 130 may have elasticity, and thus may allow the pen or the pencil stored in the writing implement storing groove 121 to be continuously and appropriately pressed by the holder 122.

According to another embodiment of the binding band 130, a user may pass the binding band 130 over or under the book body 100 in order to move the binding band 130 to the writing implement storing groove 121.

According to another embodiment of the binding band 130, the binding band 130 may be located at the opened side of the writing implement storing groove 121, and thus may prevent the writing implement stored in the writing implement storing groove 121 from being separated from the writing implement storing groove 121 together with the holder 122.

Figure 8:
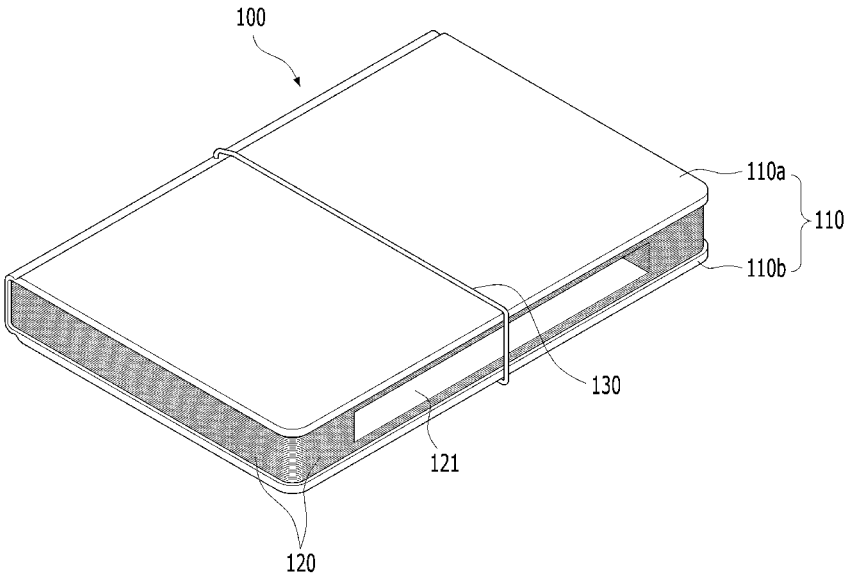
FIG. 8 is a perspective view illustrating a binding band of a book with a storage groove for writing implements according to another embodiment of the present invention.
Figure 9:
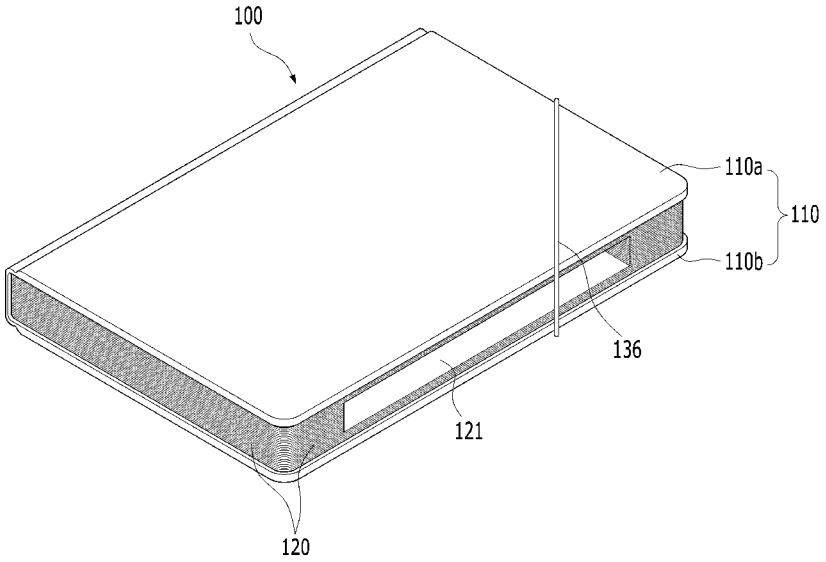
FIG. 9 is a perspective view illustrating a binding band of a book with a storage groove for writing implements according to another embodiment of the present invention.
Figure 10:
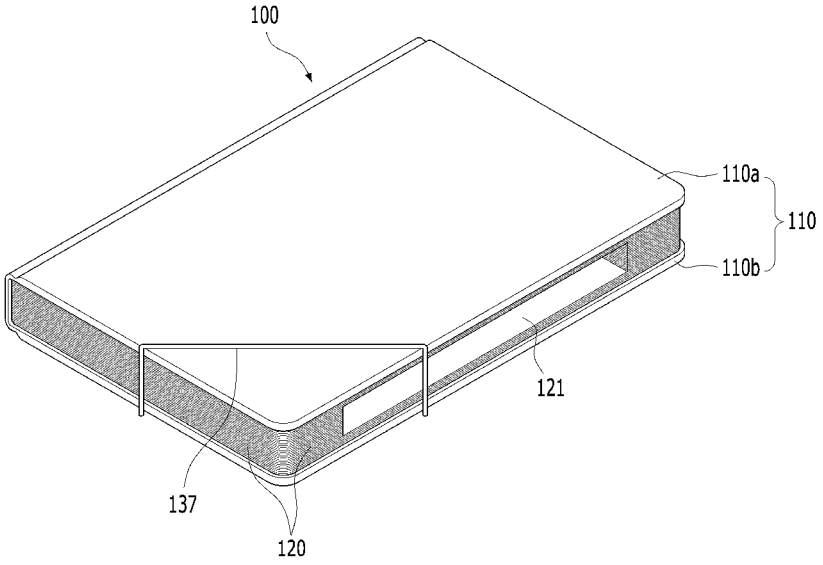
FIG. 10 is a perspective view illustrating a binding band of a book with a storage groove for writing implements according to another embodiment of the present invention.
Figure 11:
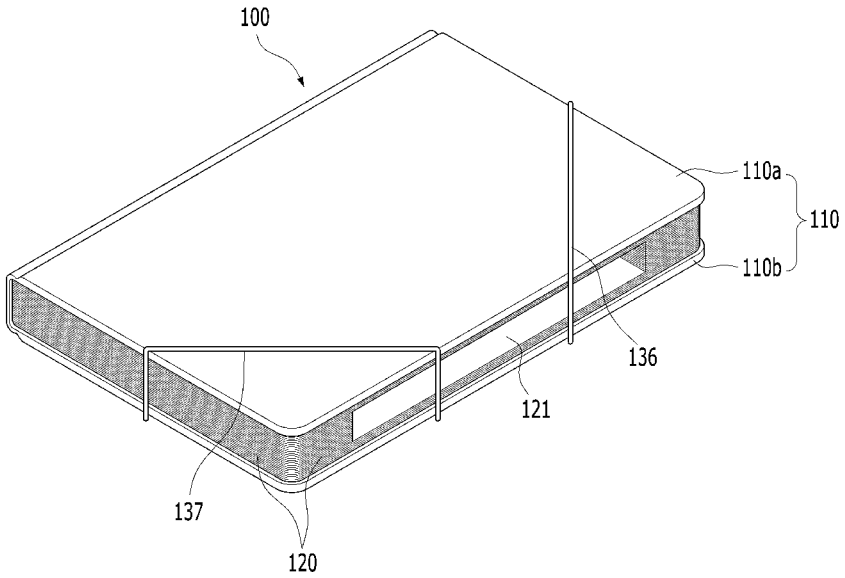
FIG. 11 is a perspective view illustrating a binding band of a book with a storage groove for writing implements according to another embodiment of the present invention.

FIG. 8 is a perspective view illustrating a binding band of a book with a storage groove for writing implements according to another embodiment of the present invention, and FIG. 9 is a perspective view illustrating a binding band of a book with a storage groove for writing implements according to another embodiment of the present invention. FIG. 10 is a perspective view illustrating a binding band of a book with a storage groove for writing implements according to another embodiment of the present invention, and FIG. 11 is a perspective view illustrating a binding band of a book with a storage groove for writing implements according to another embodiment of the present invention.

Figure 12:
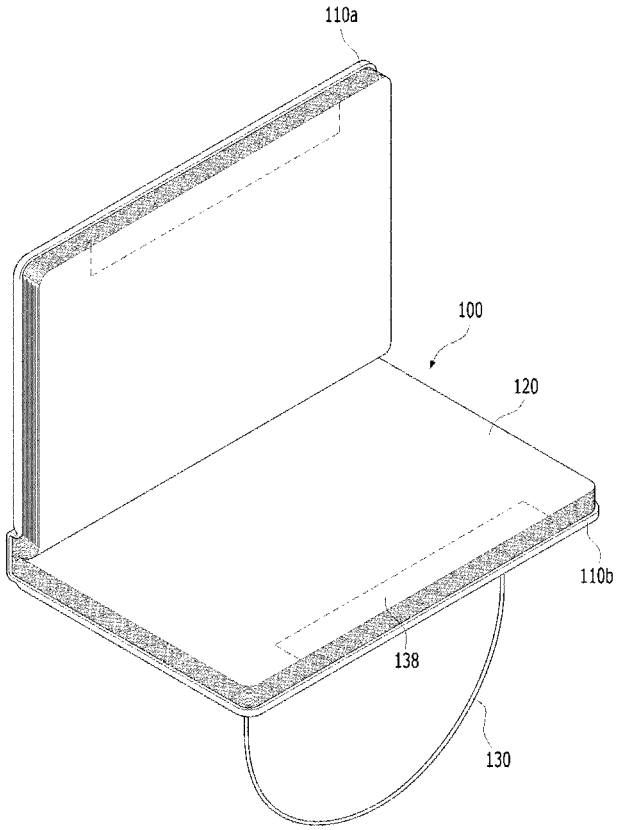
FIG. 12 is a perspective view illustrating a book with a storage groove for writing implements according to another embodiment of the present invention.

FIG. 12 is a perspective view illustrating a book with a storage groove for writing implements according to another embodiment of the present invention.

In FIG. 8, a book with a storage groove for writing implements may include an inner sheet part 120 formed by being cut into a certain size, and a cover part 110 including a front cover part 110*a* disposed to cover the front surface of the inner sheet part 120 and a back cover part 110*b* disposed to cover the rear surface of the inner sheet part 120. Also, the book may include a writing implement storing groove 121 formed at the fore-edge of the inner sheet part 120 such that a writing implement can be seen from the outside and formed in a longitudinal direction of the writing implement, and a binding band 130 formed of an elastic string and disposed to surround and bind at least one of the outside of the front cover part 110*a* and the outside of the back cover part 110*b* in a horizontal direction.

Also, the writing implement storing groove 121 may be formed to have a width such that the front cover part 110*a* or the inner sheet part 120 can pressurize the writing implement from the front side of the book and the back cover part 110*b* or the inner sheet part 120 can pressurize the writing implement from the rear side of the book to prevent the writing implement from being separated from the writing implement storing groove 121 when the book is closed. When the cover part 110 is divided into three equal parts along the vertical length from the uppermost side to the lowermost side of the cover part 110, the binding band 130 may be disposed at the intermediate region of the three equal parts.

The writing implement storing groove 121 may include a holder that is disposed on the inner sheet of the cover part 110 forming one side the writing implement storing groove 121 to press and fix the writing implement by making contact with the body of the writing implement.

Also, a cuttable surface may be formed in the inner sheet part 120 so as to adjust the thickness of the writing implement storing groove 121 according to a user's selection. The cuttable surface may be for adjusting the width of the writing implement storing groove 121 according to the thickness of the writing implement. Accordingly, a user can adjust the width of the writing implement storing groove 121 using the cuttable surface of the inner sheet part 120.

In FIGS. 9 to 11, a book with a storage groove for writing implements according to still another embodiment of the present invention may include an inner sheet part 120 formed by being cut into a certain size, a cover part 110 including a front cover part 110*a* disposed to cover the front surface of the inner sheet part 120 and a back cover part 110*b* disposed to cover the rear surface of the inner sheet part 120, a writing implement storing groove 121 formed at the fore-edge of the inner sheet part 120 such that a writing implement can be seen from the outside and formed in a longitudinal direction of the writing implement, and a binding band 130 formed of an elastic string and disposed to surround and bind at least one of the outside of the front cover part 110*a* and the outside of the back cover part 110*b* in a diagonal direction.

Also, the writing implement storing groove 121 may be formed to have a width such that the front cover part 110*a* or the inner sheet part 120 can pressurize the writing implement from the front side of the book and the back cover part 110*b* or the inner sheet part 120 can pressurize the writing implement from the rear side of the book to prevent the writing implement from being separated from the writing implement storing groove 121 when the book is closed. The binding band 130 may be disposed to surround the upper end (see FIG. 9) or the lower end (see FIG. 10) of the cover part 110 and the fore-edge of the cover part 110.

Also, as shown in FIG. 11, the writing implement storing groove 121 may be formed to have a width such that the front cover part 110*a* or the inner sheet part 120 can pressurize the writing implement from the front side of the book and the back cover part 110*b* or the inner sheet part 120 can pressurize the writing implement from the rear side of the book to prevent the writing implement from being separated from the writing implement storing groove 121 when the book is closed. The binding band 130 may include a first binding band 136 disposed to surround the upper end of the cover part 110 and the fore-edge of the cover part 110 and a second binding band 137 disposed to surround the lower end of the cover part 110 and the fore-edge of the cover part 110.

The writing implement storing groove 121 may include a holder that is disposed on the inner sheet of the cover part 110 forming one side the writing implement storing groove 121 to press and fix the writing implement by making contact with the body of the writing implement.

Also, a cuttable surface may be formed in the inner sheet part 120 so as to adjust the thickness of the writing implement storing groove 121 according to a user's selection. The cuttable surface may be for adjusting the width of the writing implement storing groove 121 according to the thickness of the writing implement. Accordingly, a user can adjust the width of the writing implement storing groove 121 using the cuttable surface of the inner sheet part 120.

FIG. 12 is a perspective view illustrating a book with a storage groove for writing implements according to another embodiment of the present invention.

The book with the storage groove for writing implements according to another embodiment of the present invention may include an inner sheet part 120 formed by being cut into a certain size, a cover part 110 including a front cover part 110*a* disposed to cover the front surface of the inner sheet part 120 and a back cover part 110*b* disposed to cover the rear surface of the inner sheet part 120, a cuttable surface 138 formed in the inner sheet part 120 so as to directly form a writing implement storing groove by removing a portion of the inner sheet part 120, and a binding band 130 formed of an elastic string and disposed to surround and bind at least one of the outside of the front cover part 110*a* and the outside of the back cover part 110*b*.

When the cuttable surface 138 is formed in the inner sheet part 120 of the book instead of forming the writing implement storing groove in advance, a user can form the writing implement storing groove by removing a portion of the inner sheet part 120 of the book using the cuttable surface 138 in accordance with the thickness of his/her writing implement.

Figure 13:
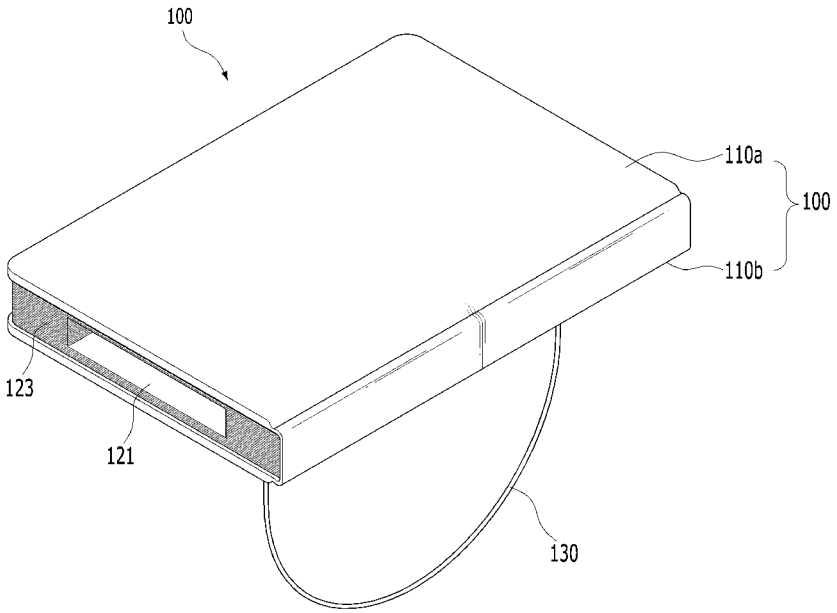
FIG. 13 is a perspective view illustrating a book with a storage groove for writing implements according to another embodiment of the present invention.
Figure 14:
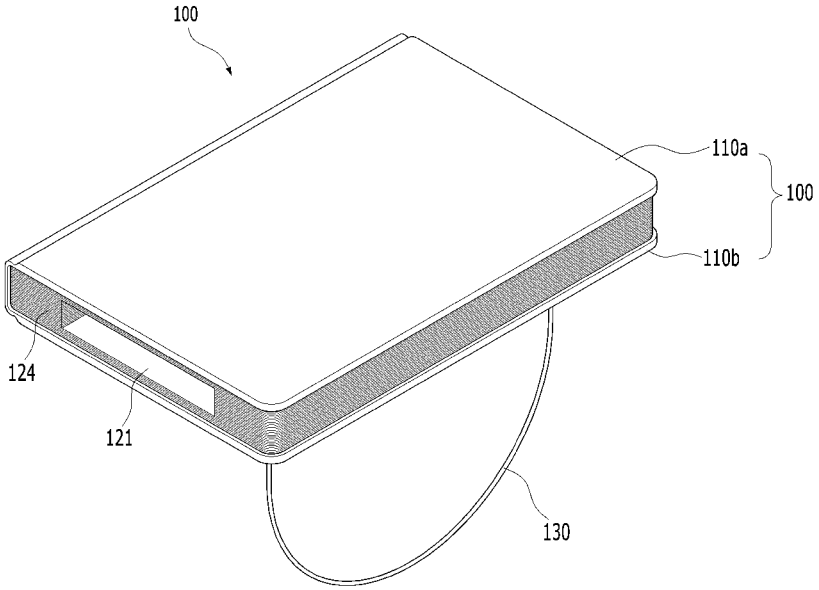
FIG. 14 is a perspective view illustrating a book with a storage groove for writing implements according to another embodiment of the present invention.

FIGS. 13 and 14 are perspective views illustrating a book with a storage groove for writing implements according to another embodiment of the present invention. In the drawings, a writing implement storing groove is shown as being formed at the uppermost side 123 of an inner sheet part and at the lowermost side 124 of the inner sheet part.

The book with the storage groove for writing implements according to another embodiment of the present invention may include an inner sheet part 120 formed by being cut into a certain size, a cover part 110 including a front cover part 110*a* disposed to cover the front surface of the inner sheet part 120 and a back cover part 110*b* disposed to cover the rear surface of the inner sheet part 120, a writing implement storing groove 121 formed such that a writing implement can be seen from the outside and formed in a longitudinal direction of the writing implement, and a binding band 130 formed of an elastic string and disposed to surround and bind at least one of the outside of the front cover part 110*a* and the outside of the back cover part 110*b*.

The writing implement storing groove 121 may be formed to have a width such that the front cover part 110*a* or the inner sheet part 120 can pressurize the writing implement from the front side of the book and the back cover part 110*b* or the inner sheet part 120 can pressurize the writing implement from the rear side of the book to prevent the writing implement from being separated from the writing implement storing groove 121 when the book is closed, and the writing implement storing groove 121 may be formed at the uppermost side 123 of the inner sheet part 120.

The writing implement storing groove 121 may be formed to have a width such that the front cover part 110*a* or the inner sheet part 120 can pressurize the writing implement from the front side of the book and the back cover part 110*b* or the inner sheet part 120 can pressurize the writing implement from the rear side of the book to prevent the writing implement from being separated from the writing implement storing groove 121 when the book is closed, and the writing implement storing groove 121 may be formed at the lowermost side 124 of the inner sheet part 120.

Thus, the writing implement storing groove can be formed at various locations in accordance with a demand of a user, and the location of the elastic band (binding band) can be freely modified.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

The invention claimed is:

1. A book with the storage groove for writing implements, comprising:

an inner sheet part formed by being cut into a certain size;

a cover part comprising a front cover part disposed to cover a front surface of the inner sheet part and a back cover part disposed to cover a rear surface of the inner sheet part;

a writing implement storing groove formed such that a writing implement is seen from outside; and a binding band formed of an elastic string and disposed to surround and bind at least one of outside of the front cover part and outside of the back cover part, wherein the writing implement storing groove is formed to have a width such that the front cover part or the inner sheet part pressurizes the writing implement from a front side of the book or the back cover part or the inner sheet part pressurizes the writing implement from a rear side of the book to prevent the writing implement from being separated from the writing implement storing groove when the book is closed.

2. The book of claim 1, wherein the writing implement storing groove formed in a horizontal direction of the writing implement such that the writing implement is seen from outside.

3. The book of claim 1, wherein the binding band is formed to surround and bind the at least one of the outside of the front cover part and the outside of the back cover part in a left and right direction, an up and down direction, or a diagonal direction.

4. The book of claim 1, further comprising a cuttable surface formed in the inner sheet part so as to adjust a thickness of the writing implement storing groove according to a user's selection.

5. A book with the storage groove for writing implements, comprising:

an inner sheet part formed by being cut into a certain size;

a cover part comprising a front cover part disposed to cover a front surface of the inner sheet part and a back cover part disposed to cover a rear surface of the inner sheet part;

a writing implement storing groove formed such that a writing implement is seen from outside; and a binding member binding and fixing the front cover part and the back cover part such that the book is not opened, wherein the writing implement storing groove is formed to have a width such that the front cover part or the inner sheet part pressurizes the writing implement from a front side of the book or the back cover part or the inner sheet part pressurizes the writing implement from a rear side of the book to prevent the writing implement from being separated from the writing implement storing groove when the book is closed.

6. The book of claim 5, where wherein the binding member performs binding using at least one of the group consisting of a magnetic binding method, a non-woven fabric binding method, a velcro binding method, a snap button binding method, a string binding method, a belt coupling method, or a belt insertion method.

7. The book of claim 5, further comprising a cuttable surface formed in the inner sheet part so as to adjust a thickness of the writing implement storing groove according to a user's selection.

* * * * *